US010957973B2

(12) United States Patent
Ariumi

(10) Patent No.: US 10,957,973 B2
(45) Date of Patent: Mar. 23, 2021

(54) ANTENNA MODULE

(71) Applicant: Murata Manufacturing Co., Ltd., Kyoto (JP)

(72) Inventor: Saneaki Ariumi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 179 days.

(21) Appl. No.: 16/266,419

(22) Filed: Feb. 4, 2019

(65) Prior Publication Data

US 2019/0173167 A1 Jun. 6, 2019

Related U.S. Application Data

(63) Continuation of application No. PCT/JP2017/020177, filed on May 31, 2017.

(30) Foreign Application Priority Data

Aug. 24, 2016 (JP) ..... JP2016-163496

(51) Int. Cl.
*H01Q 1/52* (2006.01)
*H01Q 19/00* (2006.01)
(Continued)

(52) U.S. Cl.
CPC ..... *H01Q 1/52* (2013.01); *H01Q 1/2283* (2013.01); *H01Q 1/38* (2013.01); *H01Q 1/48* (2013.01);
(Continued)

(58) Field of Classification Search
CPC ..... H01Q 1/52; H01Q 19/005; H01Q 21/065; H01Q 3/24; H01Q 1/2283; H01Q 1/38; H01Q 1/48; H01Q 9/04; H01Q 23/00
See application file for complete search history.

(56) References Cited

U.S. PATENT DOCUMENTS 6,249,242 B1 6/2001 Sekine et al.
2014/0273899 A1* 9/2014 Dokai ..... H04B 1/0078 455/180.1
(Continued)

FOREIGN PATENT DOCUMENTS

JP H05-90803 A 4/1993
JP 2000-209026 A 7/2000
(Continued)

OTHER PUBLICATIONS

International Search Report for International Application No. PCT/JP2017/020177 dated Aug. 22, 2017.
(Continued)

*Primary Examiner* — Dieu Hien T Duong
(74) *Attorney, Agent, or Firm* — Pearne & Gordon LLP

(57) ABSTRACT

The present disclosure improves, in an antenna module, the isolation characteristic between an output signal from an antenna and an input signal. An antenna module includes a dielectric substrate having a first surface and a second surface, an antenna formed on the first surface, a radio frequency element configured to supply a radio frequency signal to the antenna, and a signal terminal formed into a columnar shape using a conductive material. The signal terminal is connected to the radio frequency element by a wiring pattern in the dielectric substrate. The signal terminal is disposed outside an excitation region generated in an excitation direction of an output signal.

20 Claims, 6 Drawing Sheets

(51) Int. Cl.

| | |
|---|---|
| ***H01Q 21/06*** | (2006.01) |
| ***H01Q 3/24*** | (2006.01) |
| ***H01Q 1/22*** | (2006.01) |
| ***H01Q 23/00*** | (2006.01) |
| ***H01Q 1/38*** | (2006.01) |
| ***H01Q 1/48*** | (2006.01) |
| ***H01Q 9/04*** | (2006.01) |

(52) U.S. Cl.
CPC ..... *H01Q 3/24* (2013.01); *H01Q 9/04* (2013.01); *H01Q 19/005* (2013.01); *H01Q 21/065* (2013.01); *H01Q 23/00* (2013.01)

(56) References Cited

U.S. PATENT DOCUMENTS

| | | | | |
|---|---|---|---|---|
| 2015/0097633 | A1* | 4/2015 | DeVries | H01P 3/003 333/33 |
| 2015/0234003 | A1* | 8/2015 | Shiozaki | G01R 31/2822 324/763.01 |
| 2017/0222316 | A1 | 8/2017 | Mizunuma et al. | |
| 2017/0229769 | A1 | 8/2017 | Yokoyama et al. | |
| 2017/0317418 | A1* | 11/2017 | Garcia | G06K 19/07749 |

FOREIGN PATENT DOCUMENTS

| | | | |
|---|---|---|---|
| JP | 2004-274259 | A | 9/2004 |
| JP | 2007-013327 | A | 1/2007 |
| WO | 2016/063759 | A1 | 4/2016 |
| WO | 2016/067969 | A1 | 5/2016 |

OTHER PUBLICATIONS

Written Opinion for International Application No. PCT/JP2017/020177 dated Aug. 22, 2017.

* cited by examiner

ANTENNA MODULE

This is a continuation of International Application No. PCT/JP2017/020177 filed on May 31, 2017 which claims priority from Japanese Patent Application No. 2016-163496 filed on Aug. 24, 2016. The contents of these applications are incorporated herein by reference in their entireties.

BACKGROUND

Technical Field

The present disclosure relates to an antenna module that includes a radio frequency element and an antenna element, and specifically relates to a technique for improving the isolation characteristic between an input signal to the radio frequency element and an output signal from the antenna element.

For example, as disclosed in International Publication No. 2016/063759 (Patent Document 1) and International Publication No. 2016/067969 (Patent Document 2), an antenna module is known, which is formed as a module that combines an antenna element with a radio frequency element configured to supply a radio frequency signal to the antenna element.

For connection to an external substrate having an external device mounted thereon, the antenna module disclosed in Patent Documents 1 and 2 has a plurality of ground conductor columns and a plurality of signal conductor columns between the antenna module and the external substrate. A ground layer is disposed in a dielectric substrate where the radio frequency element and the antenna element are mounted, and the ground conductor columns are arranged along the outer edge of the dielectric substrate in such a manner as to surround the radio frequency element. This arrangement of the ground layer and the ground conductor columns provides shielding against radiation from the radio frequency element.

Patent Document 1: International Publication No. 2016/063759

Patent Document 2: International Publication No. 2016/067969

BRIEF SUMMARY

In the antenna module described above, the frequency band of an input signal transmitted to the antenna module from a device outside the module and the frequency band of an output signal radiated from the antenna element may be set to overlap.

The signal conductor columns serving as input terminals of the antenna module are typically designed to have a shape and dimensions that facilitate passage of an input signal. Therefore, if the frequency band of an output signal radiated from the antenna element is the same as the frequency band of an input signal input to the antenna module, the output signal radiated from the antenna element may also be easily received by the signal conductor columns serving as input terminals. As a result, the output signal is partially input as an input signal to the antenna module to form a signal feedback loop. This may cause noise in the output signal or may cause the output signal to oscillate.

Even when the frequency bands of input and output signals do not overlap, if electric field coupling occurs between the output signal and the signal conductor columns, the output signal may oscillate in the frequency band of an antenna output in the event of an unexpected gain in the antenna output.

The present disclosure has been made to solve the problems described above. An object of the present disclosure is to improve, in an antenna module including a radio frequency element and an antenna element, the isolation characteristic between the antenna element and an input terminal.

An antenna module according to the present disclosure includes a dielectric substrate having a first surface and a second surface, at least one antenna formed on the first surface, a radio frequency element, and at least one signal terminal. The radio frequency element is configured to supply a radio frequency signal to the at least one antenna. The at least one signal terminal is formed into a columnar shape using a conductive material and is connected by a wiring pattern in the dielectric substrate to the radio frequency element. The at least one signal terminal is disposed outside an excitation region generated in an excitation direction of an output signal radiated from the at least one antenna.

A frequency band of an input signal applied to the at least one signal terminal can at least partially overlap a frequency band of the output signal.

The radio frequency element can include an amplifier configured to amplify an input signal applied to the at least one signal terminal and supply the amplified input signal to the antenna.

The radio frequency element can be mounted on the second surface, and the at least one signal terminal can protrude from the second surface. The antenna module can further include a plurality of ground terminals protruding from the second surface and formed into a columnar shape using a conductive material. In plan view of the dielectric substrate, the plurality of ground terminals can be arranged to surround the radio frequency element along at least part of an outer edge of the dielectric substrate.

In plan view of the dielectric substrate, the plurality of ground terminals can be arranged in a plurality of rows along at least part of an outer edge of the dielectric substrate. The at least one signal terminal can be disposed inside an outermost ground terminal row.

In plan view of the dielectric substrate, the at least one signal terminal can be disposed to be surrounded by the plurality of ground terminals.

The antenna module further can include a sealing resin layer disposed on the second surface. The sealing resin layer can have the radio frequency element and the at least one signal terminal embedded therein.

A frequency band of the output signal can be a 60 GHz band. A height of the at least one signal terminal can be set to be greater than or equal to one-eighth of a wavelength of the output signal and less than or equal to the wavelength.

A frequency band of the output signal can be a 60 GHz band. The at least one signal terminal can have a cylindrical shape, and a diameter of a bottom surface of the at least one signal terminal can be set to be greater than or equal to one-eighth of a wavelength of the output signal and less than or equal to the wavelength.

The excitation region can be a region obtained by projecting the at least one antenna in the excitation direction.

In the present disclosure, in the antenna module including the radio frequency element and the antenna element, the signal terminal that receives an input signal input to the module is disposed outside the excitation region generated in the excitation direction of the antenna element. This reduces electric field coupling between an output signal radiated from the antenna element and the signal terminal. It is thus possible to reduce degradation of the isolation characteristic between the antenna element and the input terminal.

DETAILED DESCRIPTION

Figure 1:
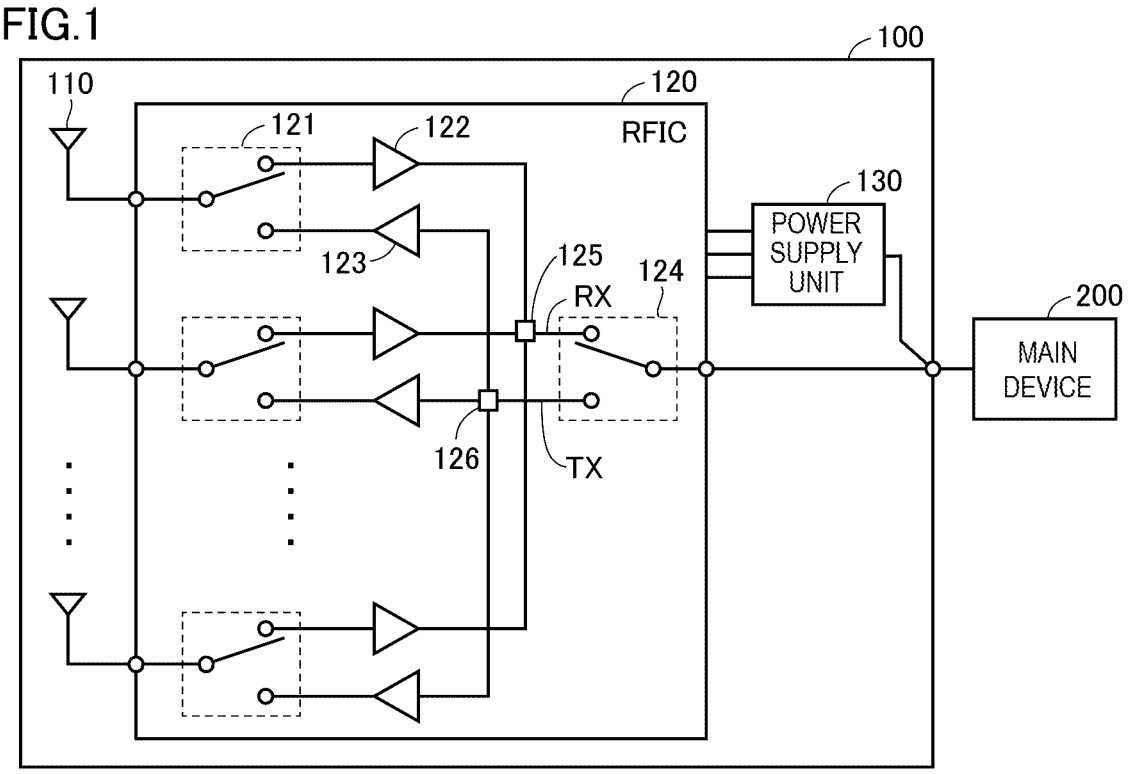
FIG. 1 is a block diagram of an antenna module according to the present embodiment.

Embodiments of the present disclosure will now be described with reference to the drawings. In the following description, the same components are denoted by the same reference numerals, and their names and functions are also the same. The detailed description of the same components will therefore not be repeated.

FIG. 1 is a functional block diagram for explaining the functions of an antenna module 100 according to the present embodiment. The antenna module 100 includes a plurality of antenna elements (hereinafter also simply referred to as "antennas") 110, a radio frequency element (hereinafter also referred to as "radio frequency integrated circuit (RFIC)") 120 connected to the antennas 110, and a power supply unit 130 configured to supply power to the RFIC 120. The antenna module 100 receives a signal transmitted from a main device 200 externally provided and radiates the signal from the antennas 110. Also, the antenna module 100 transmits a signal received by the antennas 110 to the main device 200.

The antennas 110, each operate as a radiating element configured to radiate a radio wave, and also as a receiving element configured to receive a radio wave. In the present embodiment, as described below with reference to FIG. 2, the antennas 110 are arranged in a matrix to form a phased array.

The RFIC 120 includes a switch 121, a receiver low-noise amplifier 122, and a transmit power amplifier 123 that are provided for each of the antennas 110. The RFIC 120 also includes a switch 124 connected to the main device 200 and configured to enable switching between a receive path RX and a transmit path TX, a signal combiner (combiner) 125 for combining receive signals received by the antennas 110, and a signal splitter (splitter) 126 for distributing a transmit signal from the switch 124 to each of the antennas 110. The RFIC 120 is formed, for example, as an integrated circuit component (chip) including the devices described above.

The antennas 110 are each selectively connected, by a corresponding one of the switches 121, to either the receiver low-noise amplifier 122 or the transmit power amplifier 123. The receiver low-noise amplifiers 122, each amplifies, with low noise, a receive signal received by the antenna 110. The outputs of the receiver low-noise amplifiers 122 are combined by the combiner 125, passed through the switch 124, and output to the main device 200. The transmit power amplifiers 123, each amplifies an input signal input from the main device 200 and distributed thereto by the splitter 126. The output of the transmit power amplifier 123 is passed through the switch 121, transmitted to the antenna 110, and radiated from the antenna 110. Although FIG. 1 shows an example where amplifiers, such as the receiver low-noise amplifier 122 and the transmit power amplifier 123, are formed inside the RFIC 120, these amplifiers may be formed as a circuit outside the RFIC 120. At least one of these amplifiers may be optional.

From the power and signal supplied from the main device 200, the power supply unit 130 generates a supply voltage for driving the RFIC 120.

Figure 2:
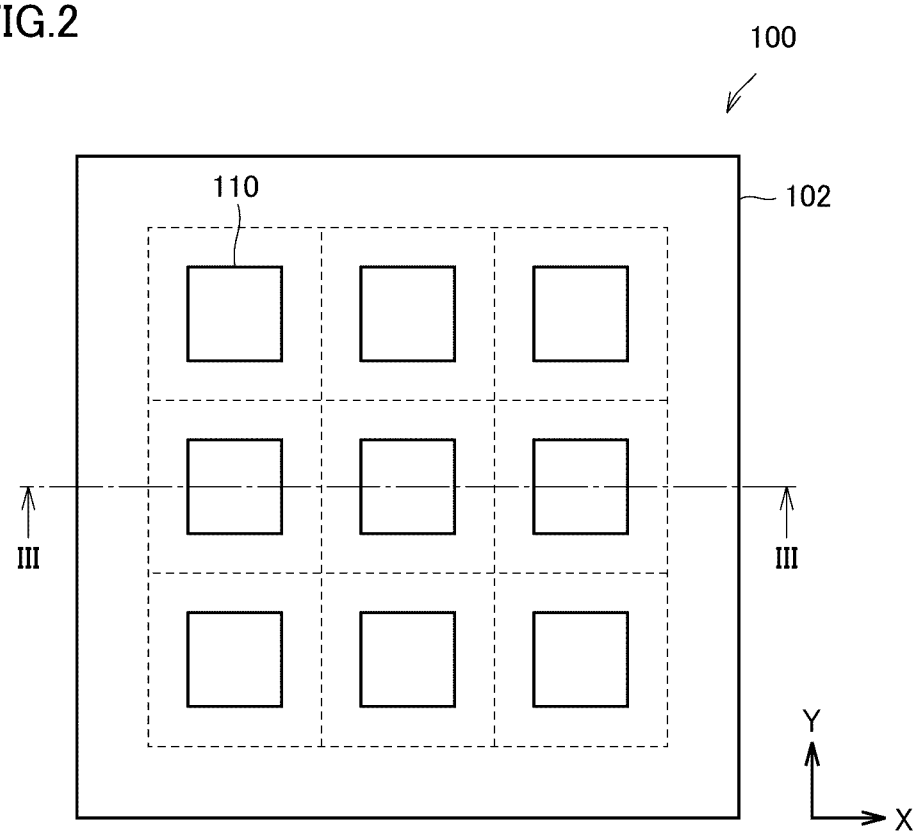
FIG. 2 is a top view of the antenna module according to the present embodiment.
Figure 3:
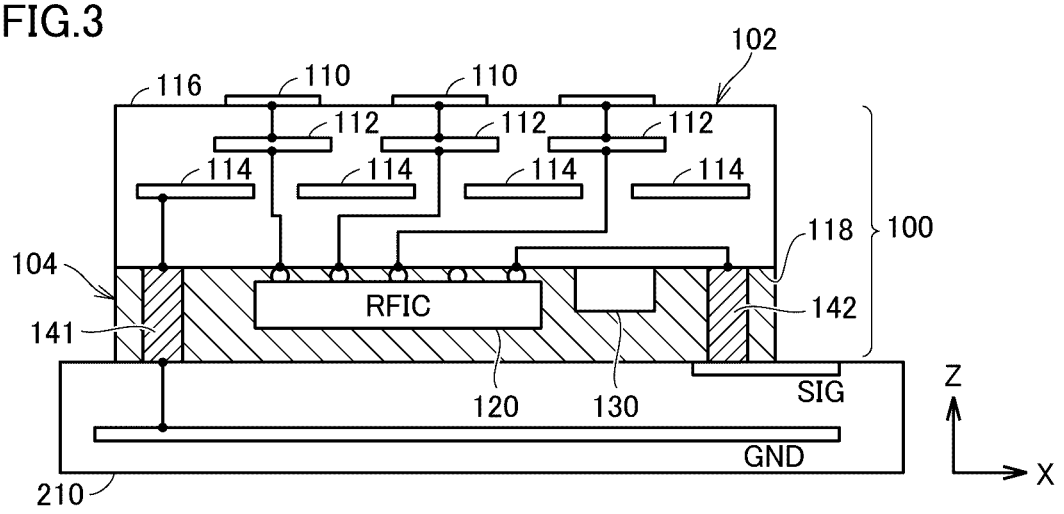
FIG. 3 is a cross-sectional view of the antenna module illustrated in FIG. 2.
Figure 4:
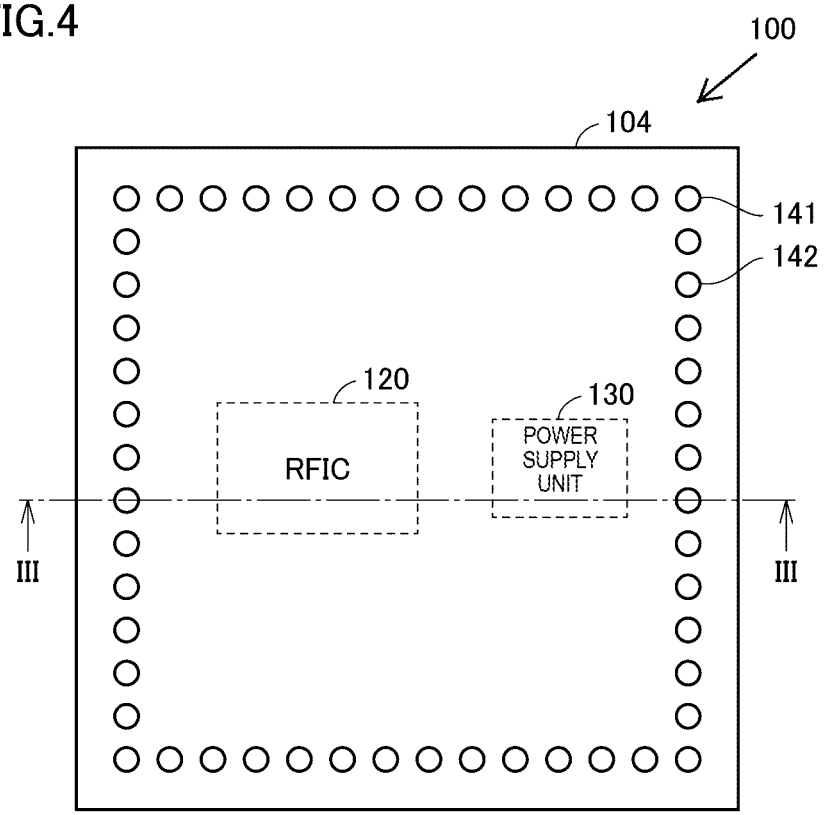
FIG. 4 is a bottom view of the antenna module illustrated in FIG. 2.

The configuration of the antenna module 100 will now be described using FIGS. 2 to 4. FIG. 2 is a plan view (top view: viewed from a direction perpendicular to an upper surface of a dielectric substrate 102) of the antenna module 100, and FIG. 3 is a cross-sectional view taken along a dotted-chain line III-III in FIGS. 2 and 4. FIG. 4 is a bottom view of the antenna module 100.

Referring to FIG. 2, the antenna module 100 includes the antennas 110 arranged in a matrix on the upper surface of the dielectric substrate 102 to form a phased array. Specifically, "m" antennas 110 are arranged in the X-direction and "n" antennas 110 are arranged in the Y-direction in FIG. 2, where "m" and "n" are both integers greater than one. FIG. 2 illustrates an exemplary configuration where the antennas 110 are arranged in a three-by-three matrix (m=3, n=3), but the number of antennas 110 is not limited to this. The present embodiment is also applicable to the configuration with only one antenna 110. The antennas 110 used here may be planar patch antennas having directivity in the direction normal to the substrate.

Referring to the cross-sectional view of FIG. 3, the dielectric substrate 102 is a multilayer substrate which is a dielectric internally provided with a plurality of conductor patterns formed in layers. For example, a low temperature co-fired ceramics (LTCC) substrate or a printed circuit board may be used as the dielectric substrate 102. An upper surface (first surface) 116 of the dielectric substrate 102 has the antennas 110 arranged thereon, and a lower surface (second surface) 118 of the dielectric substrate 102 has the RFIC 120 and the power supply unit 130 mounted thereon.

The antennas 110 are connected to the RFIC 120, with a conductor layer 112 interposed therebetween. The conductor layer 112 includes, for example, a coil and capacitors formed therein, and allows adjustment of the resonant frequency of the antennas 110 and impedance matching. When the antennas 110 include the functions of the conductor layer 112, the antennas 110 and the RFIC 120 may be directly connected by a wiring pattern. The dielectric substrate 102 includes a ground layer 114.

A plurality of ground terminals 141 and at least one signal terminal 142 are arranged on the lower surface 118 of the dielectric substrate 102. The ground terminals 141 and the signal terminal 142 are formed into a columnar shape using a conductive material and are disposed to protrude from the lower surface 118 of the dielectric substrate 102. The ground terminals 141 and the signal terminal 142 enable the dielectric substrate 102 to be electrically connected to a mount board 210 where the external main device 200 (see FIG. 1) is mounted. The external main device 200 is, for example, a CPU or a baseband integrated circuit element (neither of which is shown) and is connected to the antenna module 100 by the conductor patterns formed on the surface of and inside the mount board 210.

The signal terminal 142 is connected to the RFIC 120 by the wiring pattern in the dielectric substrate 102. The signal terminal 142 is also connected to a signal conductor pattern SIG formed on the surface of the mount board 210.

The ground terminals 141 are connected to the ground layer 114 by the wiring pattern in the dielectric substrate 102. The ground terminals 141 are also connected to a ground pattern GND inside the mount board 210 by a wiring pattern in the mount board 210.

The RFIC 120, the power supply unit 130, the ground terminals 141, and the signal terminal 142 may be molded with sealing resin to form a sealing resin layer 104. A thermosetting resin, such as epoxy resin or cyanate resin, is used as the sealing resin. The sealing resin layer 104 can not only protect devices (including the RFIC 120 and the power supply unit 130) mounted on the dielectric substrate 102 but can also enhance heat dissipation of the RFIC 120 and others.

Referring to the bottom view of FIG. 4, the ground terminals 141 and the signal terminal 142 are exposed, at lower ends thereof, from the bottom surface of the sealing resin layer 104. In plan view of the dielectric substrate 102, the ground terminals 141 and the signal terminal 142 are arranged slightly inside the outer edge of the dielectric substrate 102, along at least part of the outer edge of the dielectric substrate 102. The RFIC 120 and the power supply unit 130 are disposed inside the ground terminals 141 and the signal terminal 142, that is, disposed closer to the center of the dielectric substrate 102 than the ground terminals 141 and the signal terminal 142 are. In other words, the ground terminals 141 and the signal terminal 142 are arranged in such a manner as to surround the RFIC 120 and the power supply unit 130.

A signal transmitted from the external main device 200 (see FIG. 1) passes through the signal terminal 142 to reach the RFIC 120, by which the antenna 110 is driven to radiate the signal.

The signal terminal 142 is typically designed to have dimensions that facilitate passage of the frequency band of a signal transmitted from the main device 200. This is to reduce attenuation of a signal passing through the signal terminal 142. When $\lambda$ denotes the effective wavelength of an input signal from the main device 200, the diameter and the height (or length in the Z-direction in FIG. 3) of the signal terminal 142 are set to be greater than or equal to one-eighth of the effective wavelength and less than or equal to the effective wavelength (i.e., in the $\lambda/8$ to $\lambda$ range), and can be set to be one-quarter of the effective wavelength ($\lambda/4$) or one-eighth of the effective wavelength ($\lambda/8$). Here, the term "effective wavelength" refers to an actual wavelength which takes into account the dielectric constant in the region of interest.

An antenna module, such as that described above, has conventionally employed either a technique in which the frequency band of an output signal radiated from the antenna is made different from the frequency band of an input signal from the main device, or a technique in which the frequency band of an output signal radiated from the antenna is made the same as, or at least partially overlaps, the frequency band of an input signal received by the antenna module from the external device.

For example, communication between wireless base stations for cellular phones requires many small cell base stations to achieve a high transmission rate. To reduce the construction cost of the small cell base stations, communication between base stations has been studied to replace conventional, fiber optic wire communication with 60-GHz-band millimeter wave radio communication. In this case, receive and transmit signals of each base station are both in the 60 GHz frequency band. To simplify the devices and reduce the time required for signal processing, the signals in the 60 GHz band may also be used as signals between the antenna module and the main device.

When the signals in the 60 GHz band are also used as signals between the antenna module and the main device, a signal terminal for transmitting a signal between the antenna module and the main device is required to have dimensions that facilitate passage of a signal input from or output to the main device. As a consequence, this also facilitates passage of an output signal radiated from the antenna. Since the signal terminal also acts as a receiving antenna in this case, the output signal radiated from the antenna is partially received by the signal terminal and a feedback loop may be created between the antenna and the signal terminal. The output signal received by the signal terminal may cause noise on a signal to be output from the antenna or may oscillate when a transmit power amplifier is mounted on the RFIC as in FIG. 1.

Therefore, when the frequency band of an output signal from the antenna overlaps the frequency band of an input signal to the antenna module, it is required to ensure isolation between the output signal from the antenna and the signal terminal.

Even when the frequency band of an output signal from the antenna does not overlap the frequency band of an input signal to the antenna module, if electric field coupling occurs between the output signal and the signal terminal, the output signal may oscillate in the frequency band of an antenna output in the event of an unexpected gain in the antenna output.

In the present embodiment, as described above, planar patch antennas are used as antenna elements. The excitation direction of an electromagnetic field radiated from a patch antenna varies depending on the position of feeding from the RFIC. In the excitation direction, the radiated electromagnetic field changes more significantly than in other directions. Therefore, if the signal terminal is disposed in the excitation direction, the occurrence of electric field coupling between the output signal and the signal terminal becomes more likely.

Accordingly, the present embodiment employs a configuration in which the signal terminal 142 is disposed so as not to overlap the excitation direction of the antennas 110. This reduces electric field coupling between an output signal from the antenna 110 and the signal terminal 142 receiving an input signal and ensures an isolation characteristic.

Figure 5:
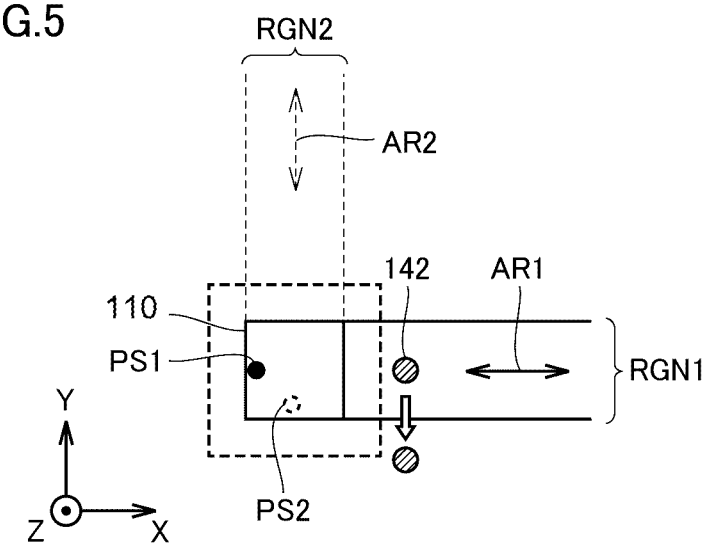
FIG. 5 is a diagram for explaining a positional relation between an antenna element and a signal terminal.

FIG. 5 is a diagram for explaining a positional relation between the excitation direction of an output signal from the antenna 110 and the signal terminal 142. FIG. 5 illustrates only one of the antennas 110 as an example.

Referring to FIG. 5, a square patch antenna is shown as an example. The antenna 110 radiates an output signal having directivity in the direction normal to the antenna 110 (i.e., in the Z-direction in FIG. 5). The excitation direction (polarization direction) of the output signal varies depending on the position of the feeding point for feeding the antenna 110.

For example, when the feeding point is provided at PS1 in FIG. 5, a polarization signal having an amplitude direction indicated by a solid arrow AR1 in FIG. 5 (X-axis direction) is radiated. Also, when the feeding point is provided at PS2 in FIG. 5, a polarization signal having an amplitude direction indicated by a dashed arrow AR2 (Y-axis direction) is radiated.

When the excitation direction is as indicated by the arrow AR1, the field strength increases in a region (excitation region) RGN1 obtained by projecting the antenna 110 in the arrow direction (X-axis direction). Therefore, if the signal terminal 142 is disposed in the excitation region RGN1, the occurrence of electric field coupling with an output signal radiated from the antenna 110 becomes more likely, and the isolation characteristic between the output signal and the signal terminal 142 may be degraded. When the signal terminal 142 is disposed outside the excitation region RGN1, it is possible to reduce the degradation of the isolation characteristic between the output signal and the signal terminal 142.

When the excitation direction is as indicated by the arrow AR2, the excitation region is a region RGN2 in FIG. 5 and thus, the signal terminal 142 is disposed outside the region RGN2. Depending on the position or number of feeding points, the excitation direction of the output signal may be, for example, the direction of a diagonal line of the antenna 110 in FIG. 5. Also, the excitation direction may vary depending on the shape of the patch antenna. Therefore, the signal terminal 142 can be designed to be disposed outside the excitation region by taking into account the excitation region determined by the shape of the patch antenna and the position of the feeding point.

Results of simulations of the isolation characteristic between an output signal and a signal terminal will now be described using FIGS. 6 and 8. The results were obtained by varying the position of the signal terminal 142 and the arrangement of the ground terminals 141 with respect to the antennas 110. FIGS. 6A-6E are for explaining the position of the signal terminal 142 in each simulation of the isolation characteristic. FIGS. 6A-6E illustrate a row of antennas 110, and the feeding point of each antenna 110 is at PS1 in FIG. 5. In any of FIGS. 6A to 6E, the excitation direction is the direction of arrow in FIGS. 6A-6E.

Figure 6A:
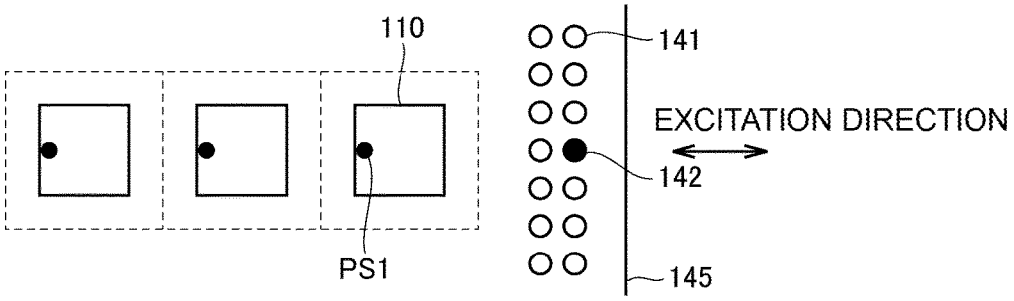
FIGS. 6A-6E are diagrams for explaining the position of the signal terminal in each simulation of an isolation characteristic.

FIGS. 6A to 6D, each illustrates a different arrangement of the ground terminals 141, with the signal terminal 142 disposed within the excitation region of the antennas 110. More specifically, FIG. 6A illustrates a configuration in which the ground terminals 141 are arranged in two rows along an outer edge 145 of the antenna module 100 and the signal terminal 142 is disposed in the outermost ground terminal row. The ground terminal row inside the outermost ground terminal row is provided to block electromagnetic field radiation (spurious radiation) from the RFIC 120 and other devices internally disposed.

Figure 6B:
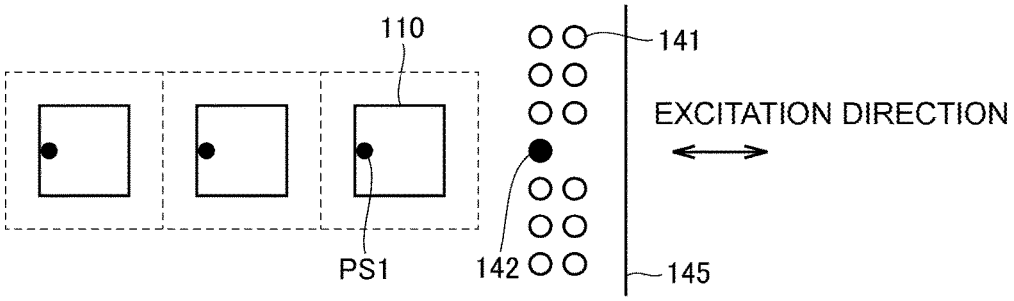
Figure 6C:
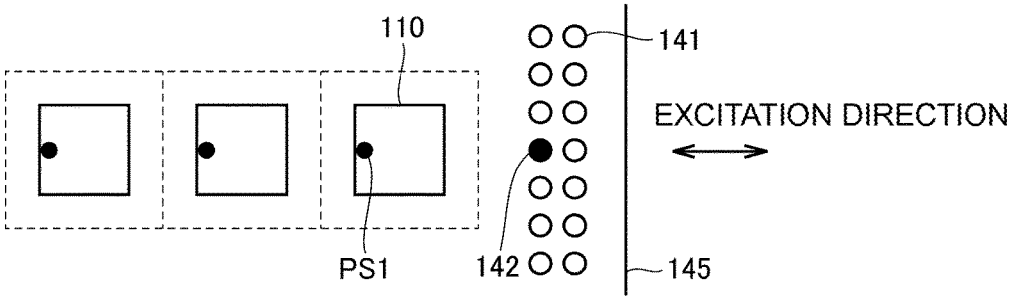

FIGS. 6B and 6C, each illustrates a configuration in which the signal terminal 142 is disposed in the inner one of the two ground terminal rows. In the configuration illustrated in FIG. 6B, no ground terminal 141 is provided outside the signal terminal 142. In the configuration illustrated in FIG. 6C, the ground terminal 141 is provided outside the signal terminal 142 to reduce effects from outside the antenna module 100.

In FIG. 6C (and FIGS. 6D and 6E mentioned below), the signal terminal 142 is disposed inside the outermost ground terminal row and the ground terminal 141 is disposed outside the signal terminal 142. In this case, as illustrated in FIG. 7, the ground pattern GND is formed on the surface of a mount board 210A and the signal conductor pattern SIG is formed inside the mount board 210A.

Figure 6D:
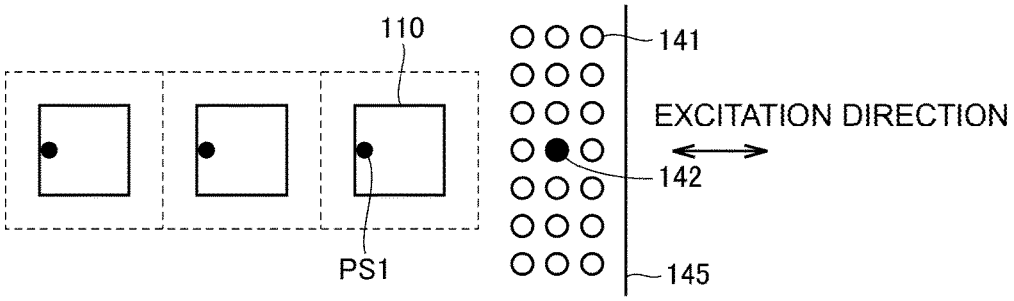
Figure 6E:
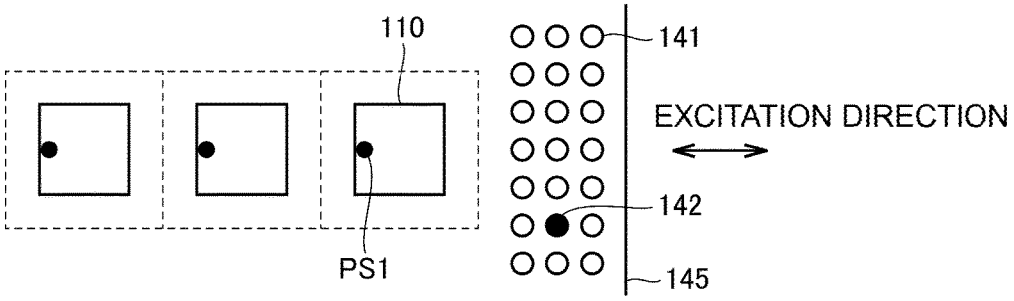
Figure 7:
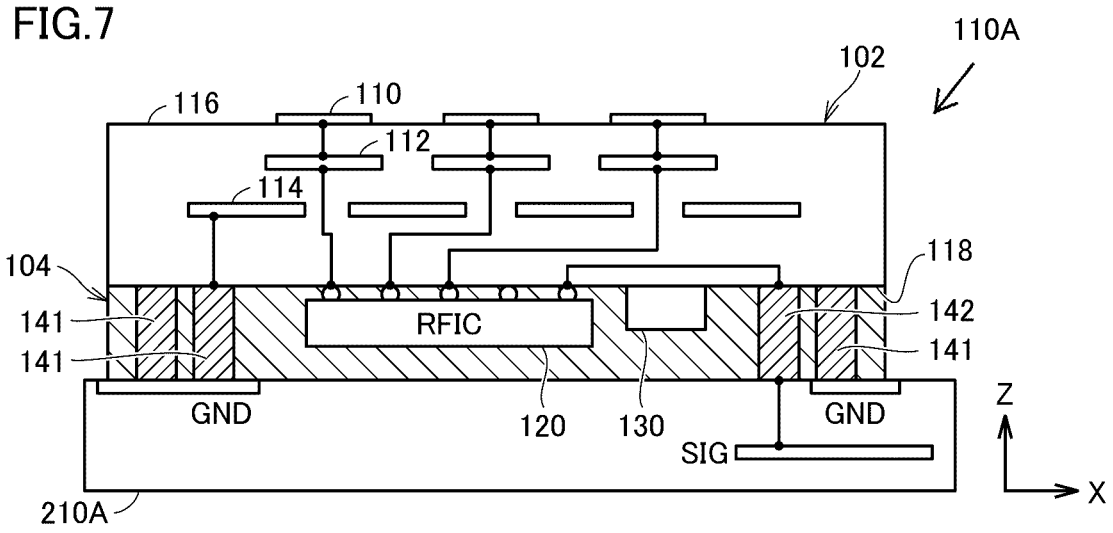
FIG. 7 is a diagram for explaining an example of connection with an external substrate in the case of FIG. 6C.

FIG. 6D illustrates a configuration obtained by adding a ground terminal row to the inside of the arrangement illustrated in FIG. 6C, so as to reduce the effects of spurious radiation from the RFIC 120 and other devices disposed inside the module. In this case, the ground terminals 141 are arranged to surround the signal terminal 142. The configuration illustrated in FIG. 6E differs from that in FIG. 6D in that the signal terminal 142 is disposed outside the excitation region of the antennas 110.

Figure 8:
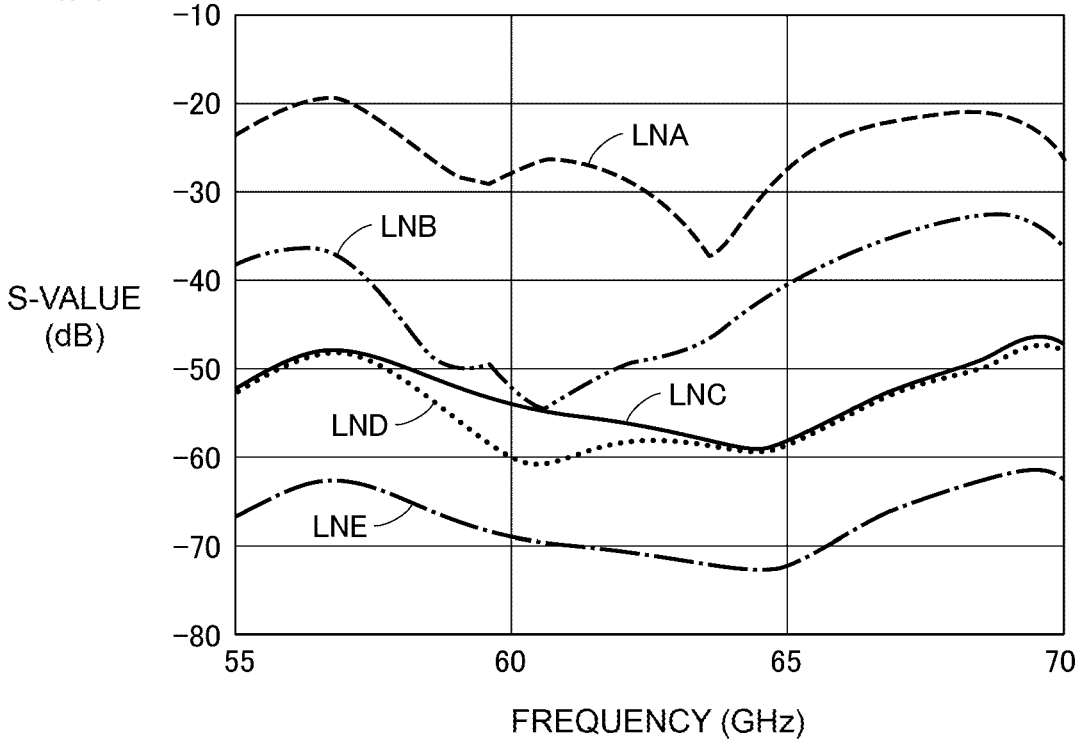
FIG. 8 is a graph showing results obtained from simulations of isolation characteristics corresponding to the positions of the signal terminal illustrated in FIGS. 6A-6E.

For the positions of the signal terminal illustrated in FIGS. 6A to 6E, FIG. 8 shows results, each obtained from the simulation of the isolation characteristic between the antenna 110 and the signal terminal 142. Here, an input signal to the antenna module 100 and an output signal from the antenna 110 both have a frequency of 60 GHz. In FIG. 8, the horizontal axis represents frequencies (55 GHz to 70 GHz) in and around the 60 GHz band, and the vertical axis represents S-values (dB) indicating isolation characteristics. Curves LNA to LNE in FIG. 8 correspond to the results of simulations performed for the configurations illustrated in FIGS. 6A to 6E.

A comparison of the curves LNA to LNC in FIG. 8 shows that the isolation characteristic obtained when the signal terminal 142 is disposed in the row inside the outermost ground terminal row (curves LNB and LNC) is about 15 dB to 20 dB better than that obtained when the signal terminal 142 is disposed in the outermost ground terminal row (curve LNA). The isolation characteristic obtained when the ground terminal 141 is disposed outside the signal terminal 142 (curve LNC) is about 5 dB to 20 dB better than that in the case of the curve LNB.

The isolation characteristic obtained when another ground terminal row is disposed inside the signal terminal 142 (curve LND) is generally substantially the same as that in the case of the curve LNC, but about 5 dB better at and around 60 GHz. This shows that the effect of a signal radiated from the antenna 110 is larger than the effect of a signal radiated from the RFIC 120. This also shows that when the ground terminals 141 are arranged to surround the signal terminal 142, the effect from the RFIC 120 can be reduced.

A comparison of the isolation characteristics between the case where the signal terminal 142 is disposed inside the excitation region of the antennas 110 (curve LND) and the case where the signal terminal 142 is disposed outside the excitation region of the antennas 110 (curve LNE) shows that the isolation characteristic obtained when the signal terminal 142 is disposed outside the excitation region of the antennas 110 is about 10 dB to 15 dB better.

The results of the simulations described above show that when signals having the same frequency are used as input and output signals, arranging the ground terminals 141 around the signal terminal 142 can reduce the effects of signals radiated from the antennas 110 and the RFIC 120 on the signal terminal 142. Additionally, disposing the signal terminal 142 outside the excitation region of the antennas 110 can improve the isolation characteristic.

Figure 9:
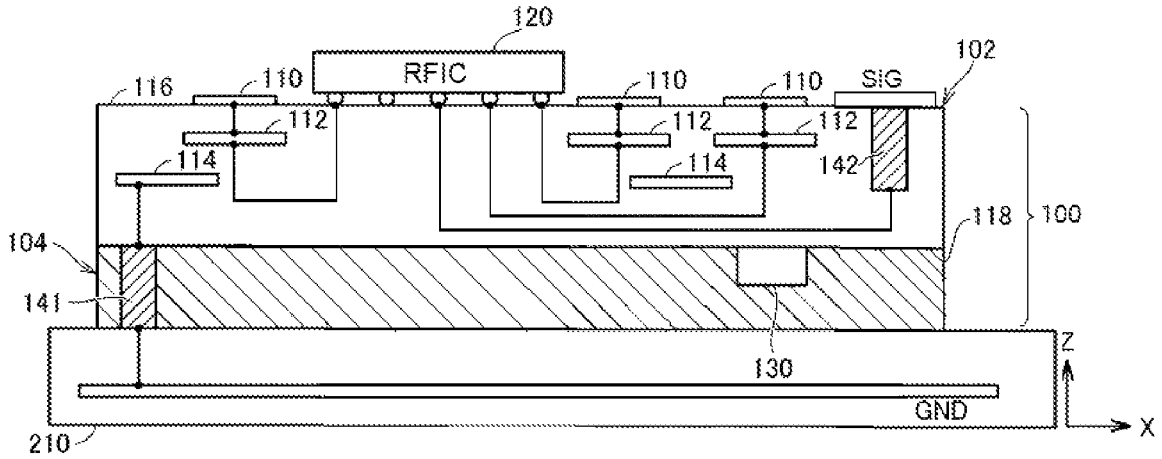
FIG. 9 is a cross-sectional view of the antenna module illustrated in FIG. 2, according to an embodiment.

Although the RFIC 120 is mounted on the lower surface 118 of the dielectric substrate 102 in the embodiments described above, the RFIC 120 may be disposed on the upper surface 116 where the antennas 110 are mounted as illustrated in FIG. 9, for example. Also, the signal terminal 142 may be formed to protrude from the upper surface 116, as shown in FIG. 9, for example, or may be formed on the side face of the dielectric substrate 102. In any of these cases, disposing the signal terminal 142 outside the excitation region of the antennas 110 can improve the isolation characteristic between the output signal and the input terminal, as in the case of the simulation described above.

The embodiments disclosed herein should be considered illustrative, not restrictive, in all aspects. The scope of the present disclosure is defined by the appended claims, not by the explanation described above. All changes made within the appended claims and meanings and scopes equivalent thereto are intended to be embraced by the present disclosure.

REFERENCE SIGNS LIST

100: antenna module, 102: dielectric substrate, 104: sealing resin layer, 110: antenna, 112: conductor layer, 114: ground layer, 116: upper surface, 118: lower surface, 120: RFIC, 121, 124: switch, 122: receiver low-noise amplifier, 123: transmit power amplifier, 125: combiner, 126: splitter, 130: power supply unit, 141: ground terminal, 142: signal terminal, 145: outer edge, 200: main device, 210, 210A: mount board, GND: ground pattern, PS1, PS2: feeding point, RGN1, RGN2: excitation region, RX: receive path, SIG: conductor pattern, TX: transmit path.

The invention claimed is:

1. An antenna module comprising:

a dielectric substrate having a first surface and a second surface;

at least one antenna provided on the first surface;

a radio frequency element configured to supply a radio frequency signal to the at least one antenna;

at least one signal terminal comprising a conductive material having a columnar shape; and a plurality of ground terminals, wherein:

the at least one signal terminal is connected to the radio frequency element by a wiring pattern in the dielectric substrate;

the at least one signal terminal is disposed outside an excitation region generated in an excitation direction of an output signal radiated from the at least one antennas;

in plan view of the dielectric substrate, the plurality of ground terminals are arranged in a line along at least a part of an outer periphery of the dielectric substrate, and the at least one signal terminal is arranged inside the line.

2. The antenna module according to claim 1, wherein a frequency band of an input signal applied to the at least one signal terminal at least partially overlaps a frequency band of the output signal.

3. The antenna module according to claim 2, wherein a frequency band of the output signal is a 60 GHz band; and a height of the at least one signal terminal is set to be greater than or equal to one-eighth of a wavelength of the output signal and lower than or equal to the wavelength.

4. The antenna module according to claim 1, wherein the radio frequency element includes an amplifier configured to amplify an input signal applied to the at least one signal terminal and to supply the amplified input signal to the antenna.

5. The antenna module according to claim 4, further comprising a sealing resin layer disposed on the second surface, wherein the radio frequency element and the at least one signal terminal are embedded in the sealing resin layer.

6. The antenna module according to claim 4, wherein a frequency band of the output signal is a 60 GHz band; and a height of the at least one signal terminal is set to be greater than or equal to one-eighth of a wavelength of the output signal and lower than or equal to the wavelength.

7. The antenna module according to claim 3, wherein a frequency band of the output signal is a 60 GHz band;

the at least one signal terminal has a cylindrical shape; and a diameter of a bottom surface of the at least one signal terminal is set to be greater than or equal to one-eighth of a wavelength of the output signal and lower than or equal to the wavelength.

8. The antenna module according to claim 1, wherein the radio frequency element is mounted on the second surface; and the at least one signal terminal protrudes from the second surface.

9. The antenna module according to claim 8, wherein the plurality of ground terminals protrude from the second surface, and each comprise a conductive material having a columnar shape, and wherein in plan view of the dielectric substrate, the plurality of ground terminals are arranged to surround the radio frequency element along at least a part of an outer edge of the dielectric substrate.

10. The antenna module according to claim 9, wherein in plan view of the dielectric substrate, the plurality of ground terminals are arranged in a plurality of rows along at least part of the outer edge of the dielectric substrate; and the at least one signal terminal is disposed inside an outermost ground terminal row.

11. The antenna module according to claim 10, wherein in plan view of the dielectric substrate, the at least one signal terminal is disposed to be surrounded by the plurality of ground terminals.

12. The antenna module according to claim 9, further comprising a sealing resin layer disposed on the second surface, wherein the radio frequency element and the at least one signal terminal are embedded in the sealing resin layer.

13. The antenna module according to claim 9, further comprising a power supply, wherein in plan view of the dielectric substrate, the radio frequency element and the power supply are arranged closer to a center of the dielectric substrate than the plurality of ground terminals and the at least one signal terminal.

14. The antenna module according to claim 1, further comprising a sealing resin layer disposed on the second surface, wherein the radio frequency element and the at least one signal terminal are embedded in the sealing resin layer.

15. The antenna module according to claim 1, wherein a frequency band of the output signal is a 60 GHz band; and a height of the at least one signal terminal is set to be greater than or equal to one-eighth of a wavelength of the output signal and lower than or equal to the wavelength.

16. The antenna module according to claim 1, wherein a frequency band of the output signal is a 60 GHz band;

the at least one signal terminal has a cylindrical shape; and a diameter of a bottom surface of the at least one signal terminal is set to be greater than or equal to one-eighth of a wavelength of the output signal and lower than or equal to the wavelength.

17. The antenna module according to claim 1, wherein the excitation region is obtained by projecting the at least one antenna in the excitation direction.

18. The antenna module according to claim 1, wherein a frequency band of an input signal applied to the at least one signal terminal is different from a frequency band of the output signal.

19. The antenna module according to claim 1, wherein a frequency band of an input signal applied to the at least one signal terminal is the same as a frequency band of the output signal.

20. The antenna module according to claim 1, wherein the radio frequency element is mounted on the first surface; and the at least one signal terminal protrudes from the first surface.

* * * * *